US005544744A

United States Patent [19]

Oman

[11] Patent Number: 5,544,744

[45] Date of Patent: Aug. 13, 1996

[54] ENGINE PARTS ORGANIZER

[76] Inventor: John I. Oman, 1714 Buchanan St., Great Falls, Mont. 59404-6228

[21] Appl. No.: 432,464

[22] Filed: May 1, 1995

[51] Int. Cl.[6] ..... B65D 85/68; B65D 85/28

[52] U.S. Cl. ..... 206/319; 206/372; 206/373; 220/507; 220/555; 312/902

[58] Field of Search ..... 206/372, 373, 206/319, 369, 379; 312/117, 126, 127, 902; 220/555, 528, 507

[56] References Cited

U.S. PATENT DOCUMENTS

| | | | |
|---|---|---|---|
| 652,778 | 7/1900 | James | 312/902 |
| 4,211,455 | 7/1980 | Tedrow | 206/373 |
| 4,550,828 | 11/1985 | Baldwin et al. | 206/373 X |
| 4,687,096 | 8/1987 | Mansur | 220/555 |
| 5,253,756 | 10/1993 | Goekler | 220/528 |
| 5,344,012 | 9/1994 | Matthews | 206/372 |

FOREIGN PATENT DOCUMENTS

| | | | |
|---|---|---|---|
| 8802681 | 4/1988 | WIPO | 206/372 |

*Primary Examiner*—Paul T. Sewell
*Assistant Examiner*—Marie Denise Patterson

[57] ABSTRACT

An engine parts organizer comprised of a parts organizer having two outer bins and an upwardly extending inner bin therebetween. A first insert is adapted to be removably coupled with the inner bin of the parts organizer. A second insert is adapted to be removably coupled with the open top of the inner bin of the parts organizer.

4 Claims, 4 Drawing Sheets

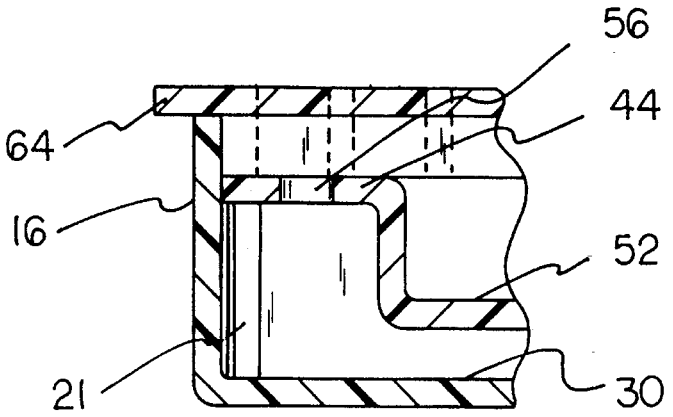
FIG. 4
FIG 5
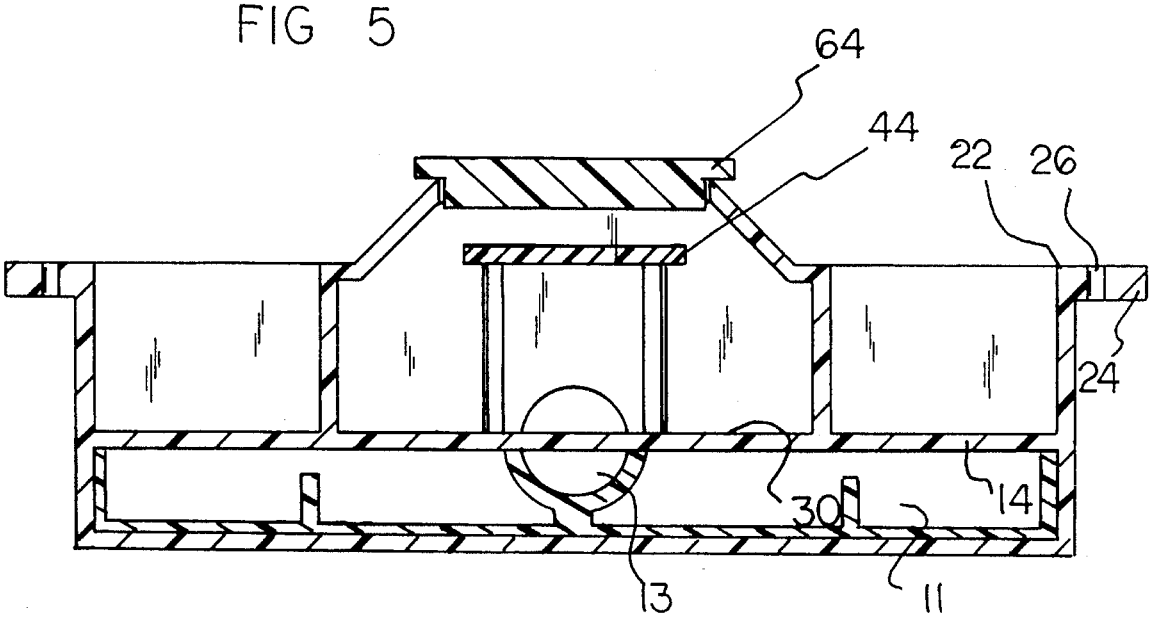

ENGINE PARTS ORGANIZER

BACKGROUND OF THE INVENTION

1. Field of the Invention

The present invention relates to an engine parts organizer and more particularly pertains to neatly organizing engine parts in an exact place as they come out of an engine with an engine parts organizer.

2. Description of the Prior Art

The use of parts holders is known in the prior art. More specifically, parts holders heretofore devised and utilized for the purpose of holding tools and parts are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,181,681 to Edwards discloses an adjustable stand apparatus.

U.S. Pat. No. Des. 333,568 to Dickinson discloses the ornamental design for a tool box and parts organizer.

U.S. Pat. No. 4,875,744 to Wettstein discloses a parts organizer.

U.S. Pat. No. Des. 303,447 to Ayres discloses the ornamental design for an engine parts tray..

U.S. Pat. No. Des. 294,209 to Havelka discloses the ornamental design for a engine parts holder.

U.S. Pat. No. Des. 286,595 to Haskell discloses the ornamental design for a holder for disassembled engine parts.

While these devices fulfill their respective, particular objective and requirements, the aforementioned patents do not describe an engine parts organizer for neatly organizing engine parts in an exact place as they come out of an engine.

In this respect, the engine parts organizer according to the present invention substantially departs from the conventional concepts and designs of the prior art, and in doing so provides an apparatus primarily developed for the purpose of neatly organizing engine parts in an exact place as they come out of an engine.

Therefore, it can be appreciated that there exists a continuing need for new and improved engine parts organizer which can be used for neatly organizing engine parts in an exact place as they come out of an engine. In this regard, the present invention substantially fulfills this need.

SUMMARY OF THE INVENTION

In the view of the foregoing disadvantages inherent in the known types of parts holders now present in the prior art, the present invention provides an improved engine parts organizer. As such, the general purpose of the present invention, which will be described subsequently in greater detail is to provide a new and improved engine parts organizer and method which has all the advantages of the prior art and none of the disadvantages.

To attain this, the present invention essentially comprises a parts organizer having two outer bins and an upwardly extending inner bin therebetween. The two outer bins have a plurality of small compartments formed therein. The two outer bins have an inner edge and an outer edge. The inner edge is integral with the upwardly extending inner bin. The outer edge has an outwardly extending lip portion integral therewith. The outwardly extending lip portion has a plurality of through holes therein. The upwardly extending inner bin has an open top and a closed bottom. The device contains a first insert having a first portion, a second portion, and an intermediate portion therebetween. The first portion has a recess formed therein. The first portion has a plurality of apertures formed on opposing sides of the recess formed therein. The first portion has a finger hole formed adjacent to an end portion thereof. The second portion has a plurality of apertures formed therethrough. The second portion has a finger hole formed adjacent to an end portion thereof. The first insert is adapted to removably couple with the inner bin of the parts organizer. The device contains a second insert having a first portion, a second portion, and an intermediate portion therebetween. The first portion and the second portion have a plurality of holes therethrough. The second insert is adapted to removably couple with the open top of the inner bin of the parts organizer.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved engine parts organizer which has all the advantages of the prior art parts holders and none of the disadvantages.

It is another object of the present invention to provide a new and improved engine parts organizer which may be easily and efficiently manufactured and marketed, It is a further object of the present invention to provide a new and improved engine parts organizer which is of durable and reliable construction.

An even further object of the present invention is to provide a new and improved engine parts organizer which is susceptible of a low cost of manufacture with regard to both materials and labor, and which accordingly is then susceptible of low prices of sale to the consuming public, thereby making such an engine parts organizer economically available to the buying public.

Still yet another object of the present invention is to provide a new and improved engine parts organizer which provides in the apparatuses and methods of the prior art some of the advantages thereof, while simultaneously overcoming some of the disadvantages normally associated therewith.

Even still another object of the present invention is to provide a new and improved engine parts organizer for neatly organizing engine parts in an exact place as they come out of an engine.

Lastly, it is an object of the present invention to provide a new and improved engine parts organizer comprised of a parts organizer having two outer bins and an upwardly extending inner bin therebetween. A first insert is adapted to removably couple with the inner bin of the parts organizer. A second insert is adapted to removably couple with the open top of the inner bin of the parts organizer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a cross-sectional view of the present invention.

FIG. 5 is a cross-sectional view as taken along line 5—5 of FIG. 2.

The same reference numerals refer to the same parts through the various Figures.

DESCRIPTION OF THE PREFERRED EMBODIMENT

Figure 1:
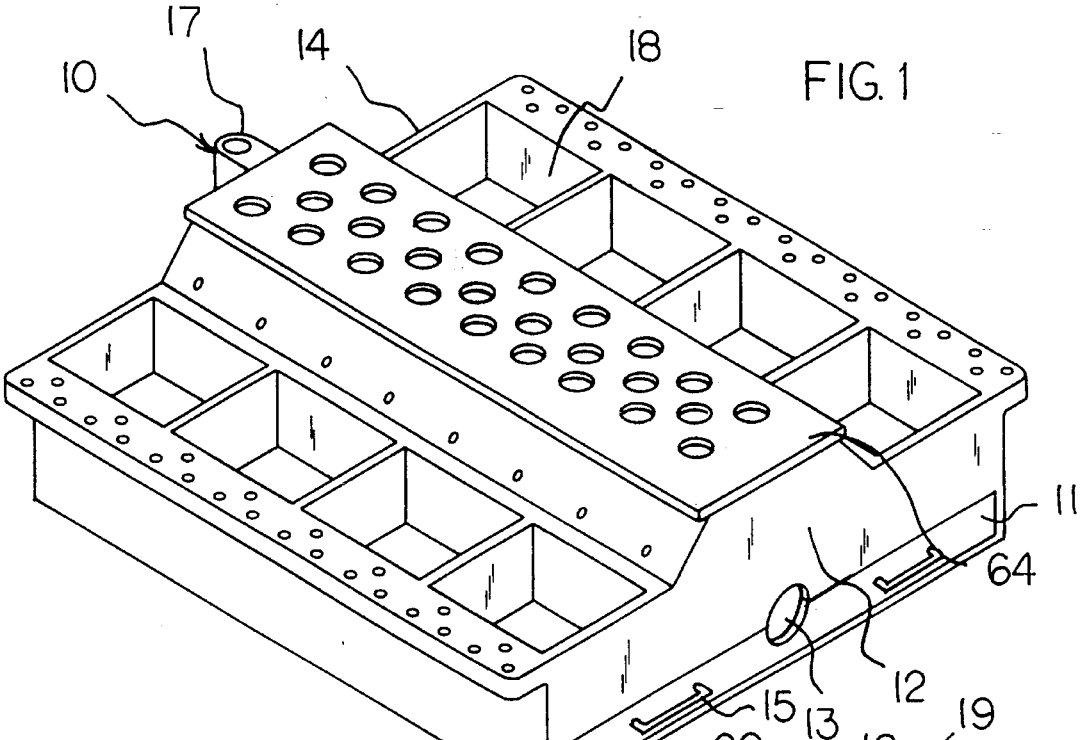
FIG. 1 is a perspective view of the preferred embodiment of the engine parts organizer constructed in accordance with the principles of the present invention.
Figure 2:
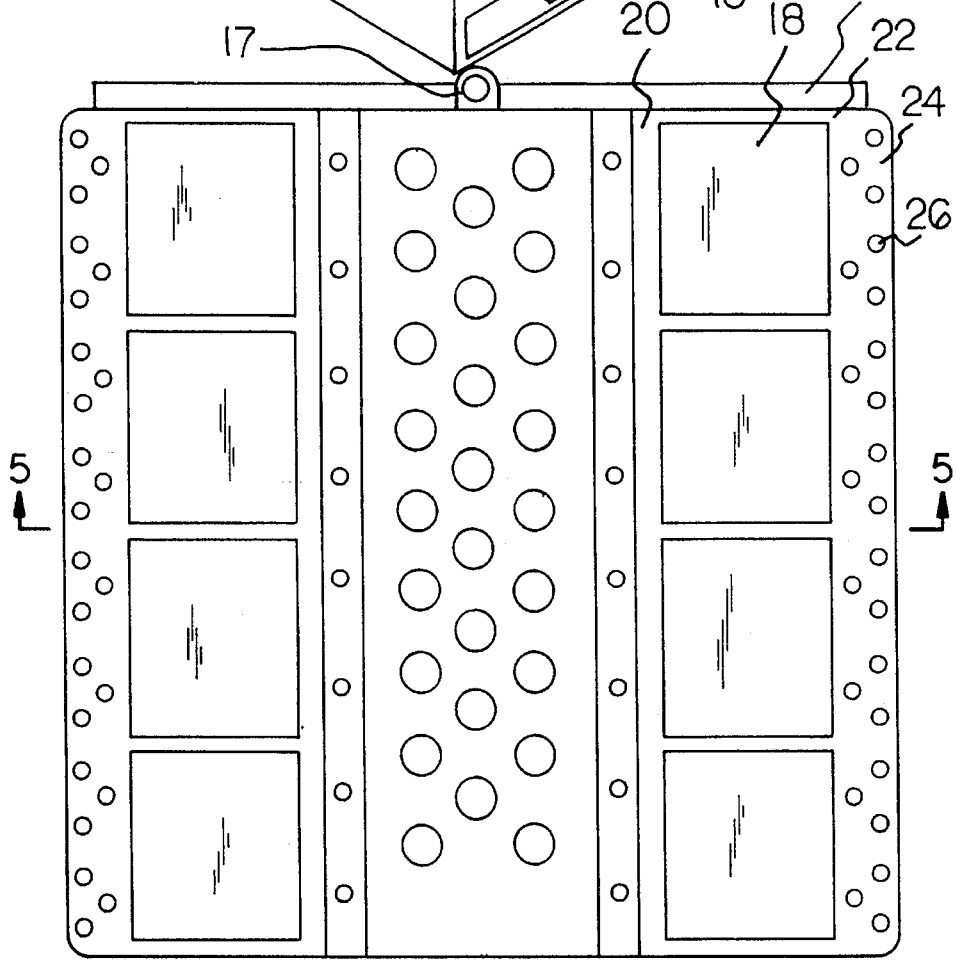
FIG. 2 is a plan view of the preferred embodiment of the present invention.
Figure 3:
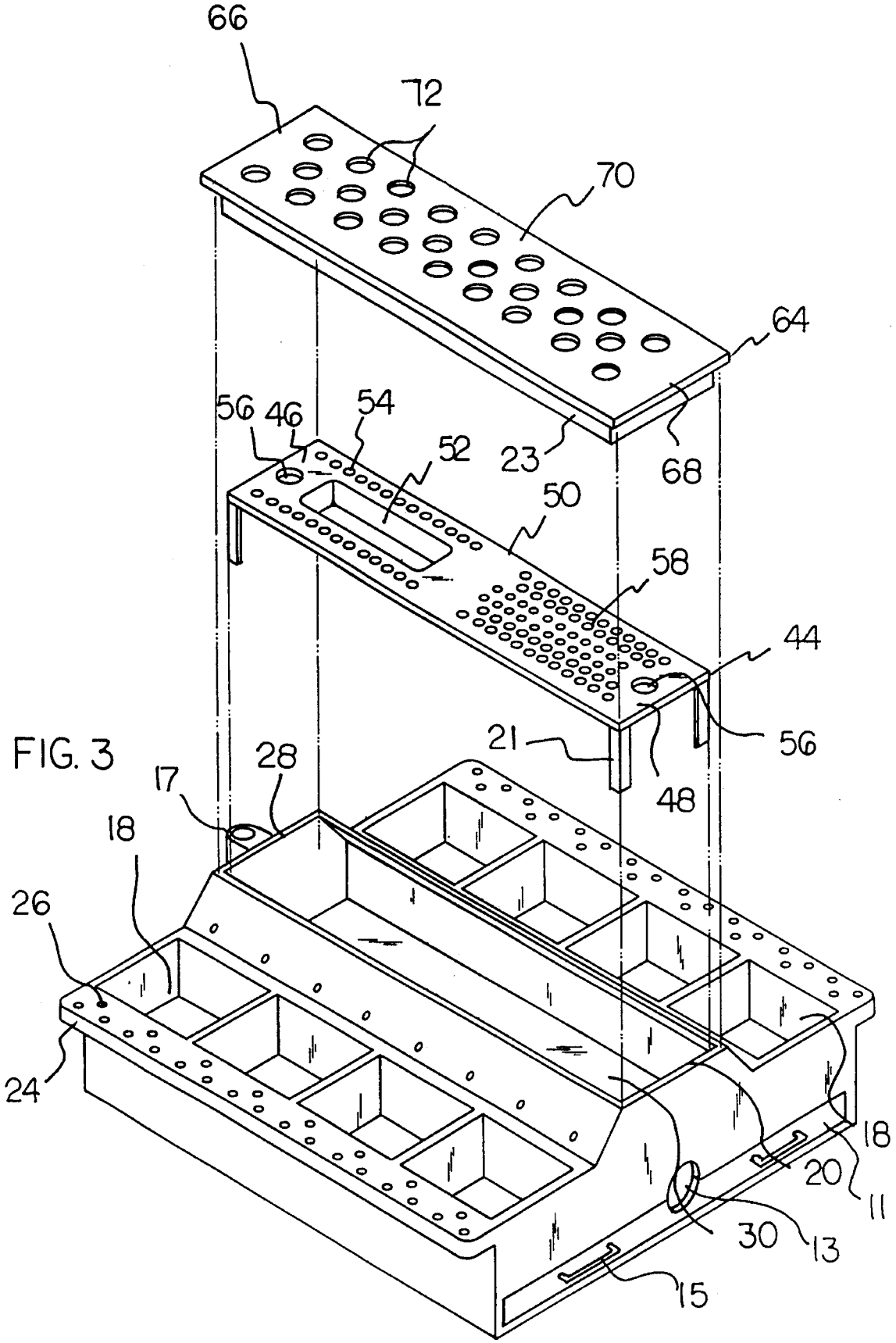
FIG. 3 is an exploded perspective view of the present invention.
Figure 6:
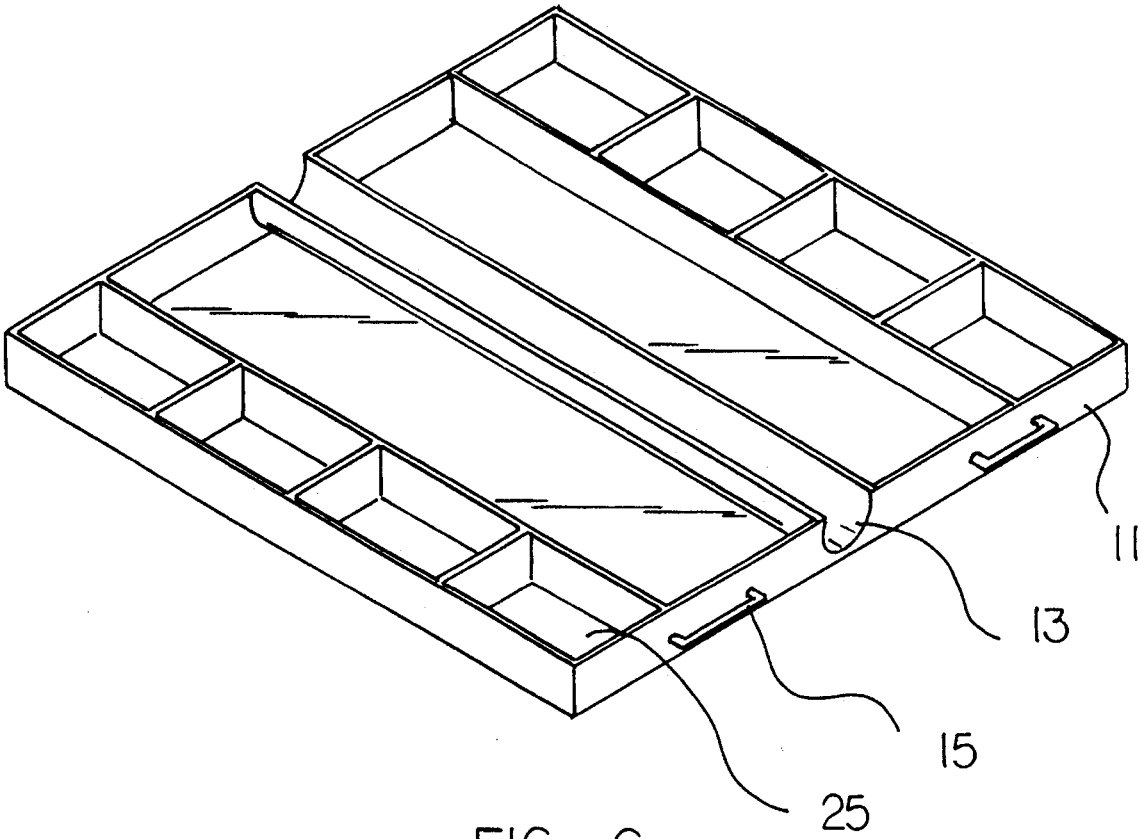
FIG. 6 is a Perspective view of the drawer of the present invention.

With reference now to the drawings, and in particular, to FIGS. 1–5 thereof, the preferred embodiment of the new and improved engine parts organizer embodying the principles and concepts of the present invention and generally designated by the reference number 10 will be described.

Specifically, it will be noted in the various Figures that the device relates to a new and improved engine parts organizer for neatly organizing engine parts in an exact place as they come out of an engine. In its broadest context, the device consists of a parts organizer, a first insert, and a second insert.

The device 10 contains a parts organizer 12. The parts organizer 12 is generally square in configuration and has an elongated opening formed in a side thereof. The elongated opening is incorporated for the receipt and removal of a parts drawer 11 therein. The drawer 11 has a central holding chamber 13 formed in a central portion thereof specifically designed to hold a cam shaft. The drawer 11 is incorporated with two U-shaped handles 15 on opposing ends thereof for the manipulation of the drawer 11. In addition, the drawer 11 is constructed with a plurality of small compartments 25 to allow for additional storage of miscellaneous engine parts. The parts organizer 12 having two outer bins 14 and an upwardly extending inner bin 16 therebetween. The inner bin 16 has a distributor holder 17 secured to an outer edge thereof. The two outer bins 14 have a plurality of small compartments 18 formed therein. The preferred number of small compartments 18 is four in each of the two outer bins 14. The small compartments 18 could be incorporated with indicia for engine parts that would be stored in the small compartments 18. An additional storage bin 19 could be added to the side portion opposing the drawer 11 to allow a user to store timing components therein. The two outer bins 14 have an inner edge 20 and an outer edge 22. The inner edge 20 is integral with the upwardly extending inner bin 16. The outer edge 22 has an outwardly extending lip portion 24 integral therewith. The outwardly extending lip portion 24 has a plurality of through holes 26 therein. The plurality of through holes 26 are used to hold valves and bolts from an engine. The upwardly extending inner bin 16 has an open top 28 and a closed bottom 30. The parts organizer 12 has a generally square configuration. The two outer bins 14 and the inner bin 16 have a generally rectangular configuration. The inner bin 16 having a depth about twice as great as the depth of the two outer bins 14. The parts organizer 12 could be constructed of wood or a rigid plastic or any other suitable material.

The device 10 contains a first insert 44 having a first portion 46, a second portion 48, and an intermediate portion 50 therebetween. The first portion 46 has a recess 52 formed therein. The recess 52 can be used to hold nuts and washers from the engine. The first portion 46 has a plurality of apertures 54 formed on opposing sides of the recess 52 formed therein. The plurality of apertures 54 can be used to hold engine bolts therein. The first portion 46 has a finger hole 56 formed adjacent to an end portion thereof. The second portion 48 has a plurality of apertures 58 formed therethrough. The second portion 48 has a finger hole 56 formed adjacent to an end portion thereof. The first portion 46 having legs 21 extending downwardly from four corners thereof. The first insert 44 is adapted to be removably coupled with the inner bin 16 of the parts organizer 12. The user can simply remove or replace the first insert 44 in relation to the inner bin 16 of the parts organizer 12 by using the finger holes 56 thereof. The first insert 44 can be labeled to indicate the positioning of engine parts therein.

The device 10 contains a second insert 64 having a first portion 66, a second portion 68, and an intermediate portion 70 therebetween. The first portion 66 and the second portion 68 have a plurality of apertures 72 therethrough. The plurality of apertures 72 can be used to hold springs and hydraulic lifters from the engine. The second insert 64 is adapted to be removably coupled with the open top 28 of the inner bin 16 of the parts organizer 12. The second insert 64 is longer than the open top 28 of the inner bin 16 thereby allowing for its easy removal to gain access to the first insert 44 positioned below the second insert 64 within the inner bin 16 of the parts organizer. The second insert 64 can be labeled to indicate the positioning of engine parts thereon.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An engine parts organizer for neatly organizing engine parts in an exact place as they come out of an engine comprising, in combination:

a parts organizer having two outer bins and an upwardly extending inner bin therebetween, the two outer bins having a plurality of small compartments formed therein, the two outer bins having an inner edge and an outer edge, the inner edge integral with the upwardly extending inner bin, the outer edge having an outwardly extending lip portion integral therewith, the outwardly extending lip portion having a plurality of through holes therein, the upwardly extending inner bin having an open top and a closed bottom, the inner bin having distributor holder secured to an outer edge thereof, the parts organizer having a side portion with an opening in the side portion and a drawer removably coupled with the opening in the side portion thereof, the drawer having handles secured thereto, the drawer having a holding chamber formed within a central portion thereof cooperating with an opening in the side portion of the parts organizer to form a circular retaining hole;

a first insert having a first portion, a second portion, and an intermediate portion therebetween, the first portion having a recess formed therein, the first portion having a plurality of apertures formed on opposing sides of the recess formed therein, the first portion having a finger hole formed adjacent to an end portion thereof, the second portion having a plurality of apertures formed therethrough, the second portion having a finger hole formed adjacent to an end portion thereof, the first insert having legs extending downwardly from four corners thereof, means to removably couple the first insert with the inner bin of the parts organizer with the legs supporting the first insert within the inner bin;

a second insert having a first portion, a second portion, and an intermediate portion therebetween, the first portion and the second portion having a plurality of apertures formed therethrough, means to removably couple the second insert with the open top of the inner bin of the parts organizer.

2. An engine parts organizer for neatly organizing engine parts in an exact place as they come out of an engine comprising, in combination:

a parts organizer having two outer bins and an upwardly extending inner bin therebetween, the inner bin having an open top;

a first insert with means for removably couple with the inner bin of the parts organizer, the first insert having lower legs;

a second insert with means for removably couple with the open top of the inner bin of the parts organizer; and the first insert having a first portion, a second portion, and an intermediate portion therebetween, the first portion having a recess formed therein, the first portion having a plurality of apertures formed on opposing sides of the recess formed therein, the first portion having a finger hole formed adjacent to an end portion thereof, the second portion having a plurality of apertures formed therethrough, the second portion having a finger hole formed adjacent to an end portion thereof.

3. The organizer as described in claim 2 and further including wherein the two outer bins of the parts organizer having a plurality of small compartments formed therein, the two outer bins having an inner edge and an outer edge, the inner edge integral with the upwardly extending inner bin, the outer edge having an outwardly extending lip portion integral therewith, the outwardly extending lip portion having a plurality of through holes therein.

4. The organizer as described in claim 2 and further including wherein the second insert having a first portion, a second portion, and an intermediate portion therebetween, the first portion and the second portion having a plurality of apertures formed therethrough, the second insert having means for removably couple with the open top of the inner bin of the parts organizer.

* * * * *